US009162510B2

(12) United States Patent
Matsumoto et al.

(10) Patent No.: US 9,162,510 B2
(45) Date of Patent: Oct. 20, 2015

(54) IMAGE FORMING APPARATUS

(71) Applicants: Kazuyoshi Matsumoto, Tokyo (JP); Norikazu Yanase, Kanagawa (JP)

(72) Inventors: Kazuyoshi Matsumoto, Tokyo (JP); Norikazu Yanase, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/485,956

(22) Filed: Sep. 15, 2014

(65) Prior Publication Data

US 2015/0091971 A1 Apr. 2, 2015

(30) Foreign Application Priority Data

Oct. 2, 2013 (JP) ..... 2013-206993
Dec. 28, 2013 (JP) ..... 2013-273647

(51) Int. Cl.
*B41J 2/015* (2006.01)
*B41J 29/393* (2006.01)

(52) U.S. Cl.
CPC ..... *B41J 29/393* (2013.01); *B41J 2029/3932* (2013.01)

(58) Field of Classification Search
CPC ... B41J 2/015; B41J 29/393; B41J 2029/3932
USPC ..... 347/20
See application file for complete search history.

(56) References Cited

U.S. PATENT DOCUMENTS

| | | | | |
|---|---|---|---|---|
| 7,832,827 | B2 * | 11/2010 | Taira | 347/20 |
| 2011/0273511 | A1 * | 11/2011 | Yanase et al. | 347/31 |
| 2011/0279499 | A1 | 11/2011 | Kemma et al. | |
| 2012/0293583 | A1 | 11/2012 | Kemma et al. | |
| 2013/0003121 | A1 | 1/2013 | Matsumoto et al. | |
| 2013/0257986 | A1 | 10/2013 | Yanase et al. | |
| 2014/0292897 | A1 * | 10/2014 | Tsuyama | 347/20 |

FOREIGN PATENT DOCUMENTS

| | | | |
|---|---|---|---|
| JP | 2004-122482 | | 4/2004 |
| JP | 2004122482 | A * | 4/2004 |

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

An image forming apparatus includes an apparatus body; a recording head to discharge droplets onto a recording medium, wherein a mist is generated when droplets are discharged to form an image; a battery, detachably disposed inside the apparatus body, to supply power necessary for operation of the apparatus body; and a connection terminal to connect the battery to the apparatus body and disposed outside a movement of the mist generated when the recording head discharges the droplets.

8 Claims, 10 Drawing Sheets

IMAGE FORMING APPARATUS

CROSS-REFERENCE TO RELATED APPLICATIONS

The present application claims priority pursuant to 35 U.S.C. §119(a) from Japanese patent application numbers 2013-206993 and 2013-273647, filed on Oct. 2, 2013 and Dec. 28, 2013, respectively, the entire disclosures of which are incorporated by reference herein.

BACKGROUND

1. Technical Field

Exemplary embodiments of the present invention relate to an image forming apparatus, and, in particular, to an image forming apparatus including a recording head to discharge droplets and which can be driven by a battery.

2. Background Art

Among various types of image forming apparatuses including a printer, a facsimile machine, a copier, a plotter, and a multifunction apparatus combining several capabilities of the above devices, an inkjet recording apparatus is known in which a recording head formed of a liquid discharge head (droplet discharge head) to discharge droplets is employed.

Among such image forming apparatuses there are those which are powered by a battery. For example, a charging device including a battery and a battery charger is attached externally to the body of the image forming apparatus and the image forming apparatus and the charging device are both installed in a cradle that functions as a stand, so that the battery in the charging device can be charged.

However, in the above battery-powered system in which the battery is connected externally to the body of the apparatus, when the battery is left behind, the apparatus cannot be operated, which is not convenient.

Conceivably, the battery may be detachably attached inside the image forming apparatus. However, in such an apparatus, to form an image through the droplet discharge method, ink mist generated during image formation coats the connection between the battery and the apparatus and can cause a connection failure that results in a power failure.

SUMMARY

In one embodiment of the disclosure, there is provided an improved image forming apparatus including an apparatus body; a recording head to discharge droplets onto a recording medium, wherein a mist is generated when droplets are discharged to form an image; a battery, detachably disposed inside the apparatus body, to supply power necessary for operation of the apparatus body; and a connection terminal to connect the battery to the apparatus body and disposed outside a movement of the mist generated when the recording head discharges the droplets.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described with reference to accompanying drawings.

Figure 1:
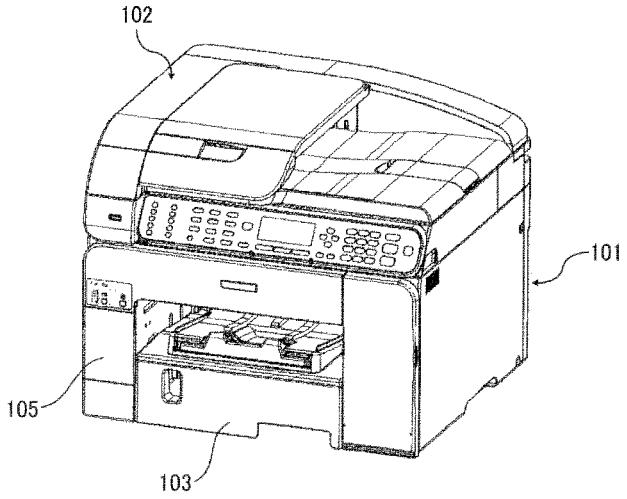
FIG. 1 is an external perspective view of an image forming apparatus according to a first embodiment of the present invention.
Figure 2:
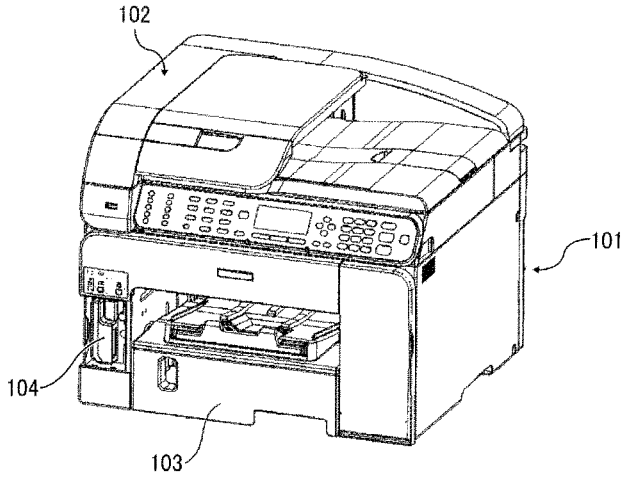
FIG. 2 is an external perspective view of the image forming apparatus from which a battery cover is removed.
Figure 3:
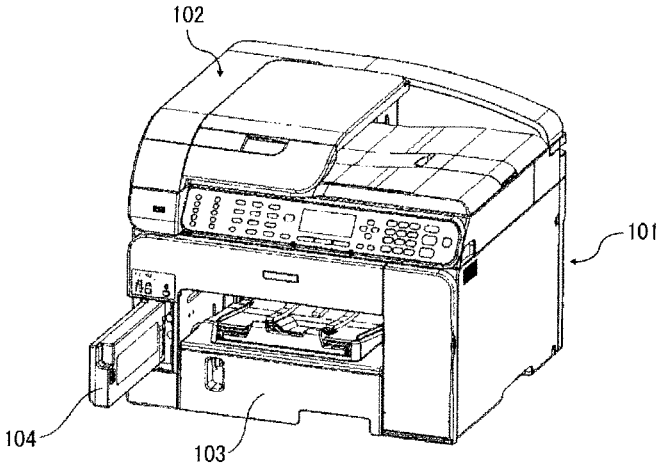
FIG. 3 is an external perspective view of the image forming apparatus from which a battery the process of being removed.

FIG. 1 is an external perspective view of an image forming apparatus 100 according to a first embodiment of the present invention; FIG. 2 is an external perspective view of the apparatus, from which a battery cover is removed; and FIG. 3 is an external perspective view of the apparatus, from which a battery is in the process of being removed.

In the present embodiment, the image forming apparatus 100 is a serial-type image forming apparatus configured of a body 101 and a scanner 102 disposed on top of the body 101.

A sheet feed and discharge cassette 103 is detachably disposed at a front of the apparatus body 101. The sheet feed and discharge cassette 103 combines functions of a sheet feed cassette containing to-be-recorded media and a discharge tray to receive the recorded media on which an image has been formed.

A battery 104 supplies electric power necessary to operate each part of the apparatus body 101 and is detachably disposed at one side of apparatus body 101. The battery 104 is covered by a battery cover 105.

Figure 4:
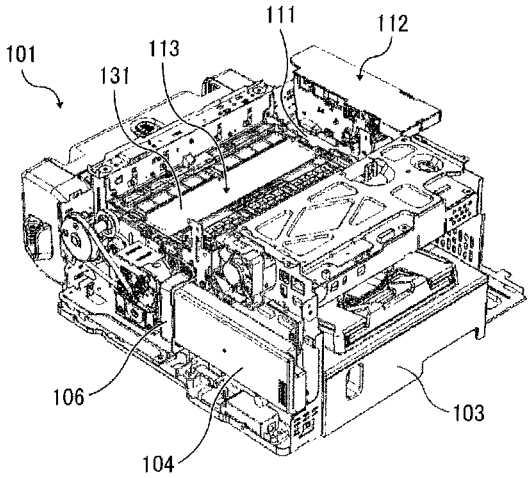
FIG. 4 is an explanatory perspective view illustrating an interior mechanical section of the apparatus to which the battery is attached.
Figure 5:
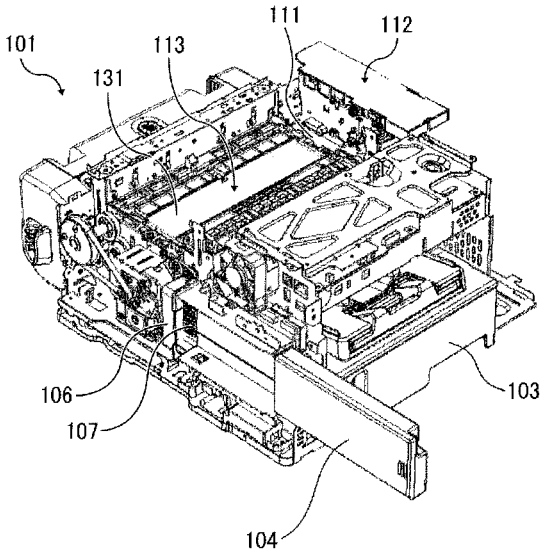
FIG. 5 is an explanatory perspective view illustrating the interior mechanical section of the apparatus from which the battery is in the process of being removed.

FIG. 4 is an explanatory perspective view illustrating an interior mechanical section of the apparatus to which the battery is attached. FIG. 5 is an explanatory perspective view illustrating the interior mechanical section of the apparatus from which the battery is in the process of being removed.

The apparatus body 101 includes a battery socket 106 to which the battery 104 is detachably attached. The battery socket 106 includes a connection terminal 107 for supplying power. The connection terminal 107 serves as a connector to which a supply terminal of the battery 104 is connected when the battery 104 is attached to the apparatus body 101.

A carriage unit 112 including two recording heads 111 each to form an image on a recording medium by discharging droplets thereon, is disposed inside the apparatus body 101. The carriage unit 112 is reciprocally movable in a main scanning direction perpendicular to a medium-conveying direction.

In addition, a conveyor section 113 to convey the recording medium or a sheet is disposed opposite the carriage unit 112. The conveyor section 113 employs a conveyance belt 131 in the present embodiment; however, alternatively, the conveyor section 113 may employ a conveyance roller and a platen member that form a conveyance guide unit, not limited to the belt unit.

Figure 6:
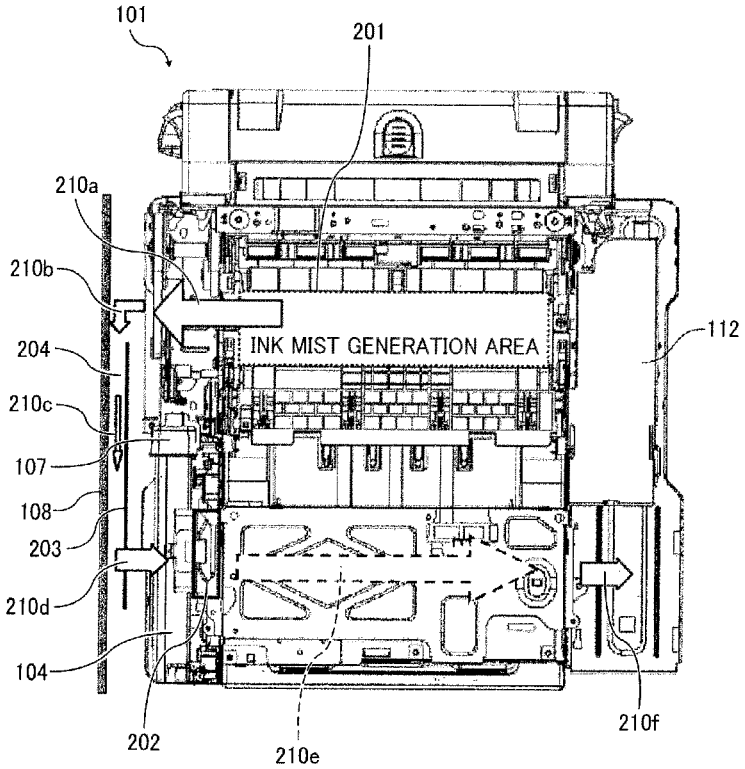
FIG. 6 is a plan view illustrating a movement of a mist.
Figure 7:
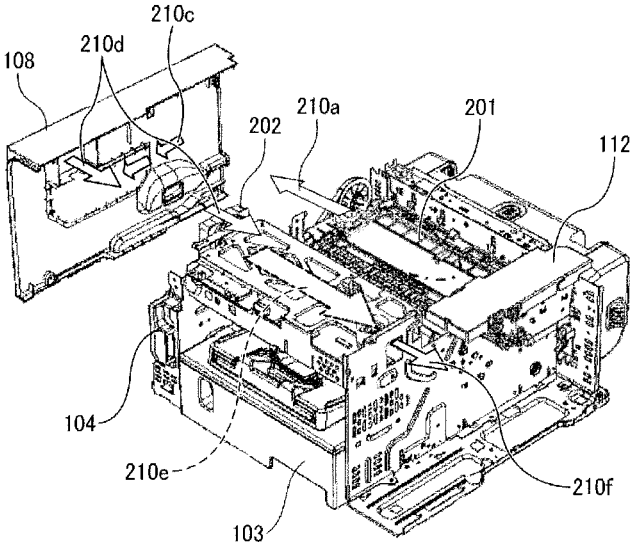
FIG. 7 is a perspective view illustrating the movement of the mist of FIG. 6.
Figure 8:
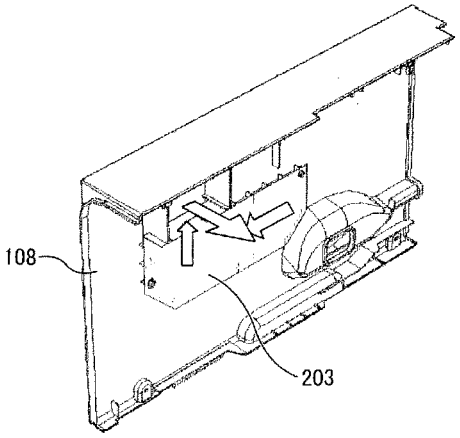
FIG. 8 is a perspective view of a side cover illustrating how the mist is collected.
Figure 9:
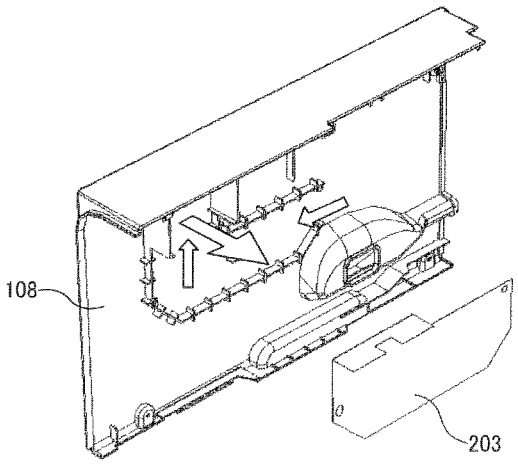
FIG. 9 is an exploded view of the side cover of FIG. 8.

FIG. 6 is a plan view and FIG. 7 is a perspective view illustrating movement of ink mist generated during image formation; FIG. 8 is a perspective view of a side cover illustrating how the mist is collected; and FIG. 9 is an exploded view of the side cover of FIG. 8.

In the present mage forming apparatus, the mist is generated when the recording heads 111 discharge droplets to thereby form an image while the carriage unit 112 moves reciprocally. As illustrated in FIG. 6, an area above the conveyance belt 131 of the conveyor section 113 corresponds to a mist generation area 201.

In the image forming apparatus of the present embodiment, the apparatus body 101 includes a fan 202 to generate airflow to collect the mist generated. Then, the mist generated in the mist generation area 201 forms movements 210*a* to 210*f* as illustrated in FIG. 6.

Specifically, the mist is conveyed from the mist generation area 201 to a left cover 108 of the apparatus body 101. Then, the mist moves inside a duct 204 that guides the mist movement 210*c* and is disposed between the left cover 108 and a duct forming member 203 that serves as a partition member, is sucked in by the fan 202, passes above a front frame member 109, and is discharged from a right side of the apparatus body 101.

As illustrated in FIG. 9, the duct forming member 203 is fixed to a rib 108*a* disposed on the left cover 108 by double-sided tape or an adhesive.

The position of the carriage unit 112 shown in FIG. 6 is a home position of the carriage unit 112. A maintenance unit to maintain the recording heads 111 in good condition is disposed at the home position. The maintenance unit includes caps to cap each of the recording heads 111 and wiper to wipe each nozzle surface of the recording heads 111.

To collect the mist generated in the mist generation area 201, the carriage unit 112 is best guided to a position opposite the home position.

On the other hand, in a system using the battery 104 that operates each part of the apparatus body 101, if the battery, the recording heads 111 positioned at the home position, and the maintenance unit are positioned proximally to each other, heat generated in the battery 104 adversely affects to the recording heads 111 and the maintenance unit. As a result, ink agglomeration or solidification inside the nozzle causes defective discharge of droplets, and the waste liquid adhered to the wiper is solidified and causes defective recovery of the maintenance unit.

To prevent such a failure, maintenance unit and the battery 104 are preferably separated from each other. In the present embodiment, the maintenance unit and the battery 104 are positioned at opposed lateral ends of the main scanning direction of the apparatus body 101. With this configuration, the battery 104 and the battery socket 106 are disposed at a side guiding the mist generated in the mist generation area 201.

As a result, when the mist generated in the mist generation area 201 is guided to a position opposite the home position of the carriage unit 112, the mist should move in the vicinity of the battery 104. At this time, if the mist adheres to the connection terminal 107 of the battery socket 106, contact failure occurs or resistance increases, thereby causing a power shortage.

To cope with the above problem, in the present embodiment, the duct 204 is formed between the left cover 108 and the duct forming member 203 in the vicinity of the battery 104. The connection terminal 107 as a connector to the battery 104 is partitioned and shielded by the duct forming member 203 from the duct 204 in which the mist moves.

Thus, the connector of the battery of the apparatus body is shielded from the movement of the mist that is generated when the droplet is discharged from the recording head. As a result, a configuration in which the battery is detachably disposed inside the apparatus can be adopted, with the connector of the battery of the apparatus body being shielded from the mist, and a stable power supply is continued.

Figure 10:
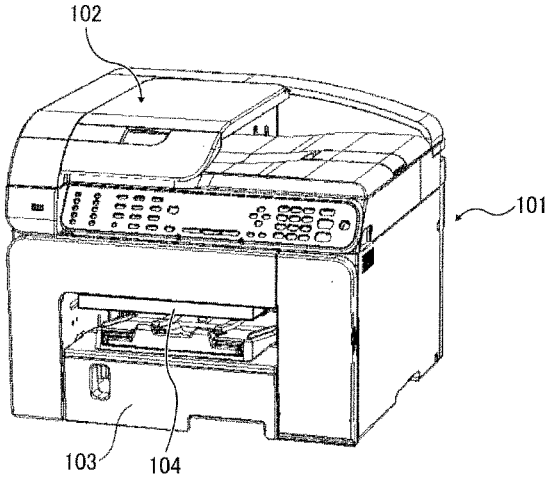
FIG. 10 is an external perspective view of an image forming apparatus according to a second embodiment of the present invention.
Figure 11:
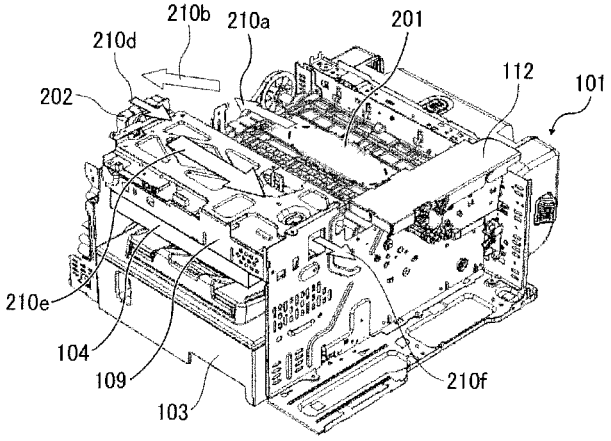
FIG. 11 is a perspective view illustrating an interior of the image forming apparatus of FIG. 10.

FIG. 10 is an external perspective view of an image forming apparatus according to a second embodiment of the present invention. FIG. 11 is a perspective view illustrating an interior of the image forming apparatus of FIG. 10.

The battery 104 is disposed above the sheet feed and discharge cassette 103 including the sheet feed cassette and is detachably attached to the apparatus body 101 at a position between the sheet feed and discharge cassette 103 and a front frame member 109 of the apparatus body 101.

At this time, the connection terminal 107 is shielded from the mist movement or the duct 210*e* by the battery 104 and the front frame member 109.

With this configuration, mist does not adhere to the connection terminal 107 with the battery 104 of the apparatus body 101 disposed on the battery socket.

Figure 12:
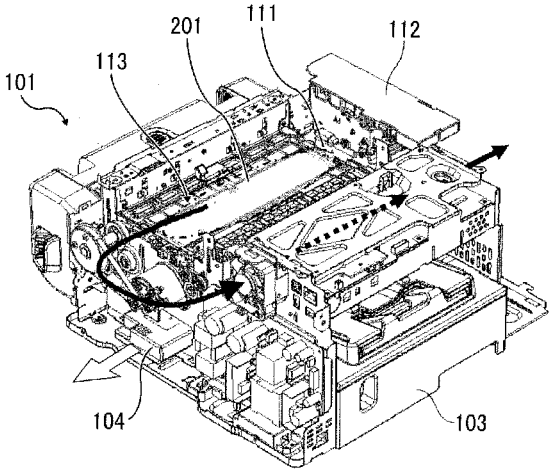
FIG. 12 is a perspective view illustrating an interior of an image forming apparatus according to a third embodiment of the present invention.

FIG. 12 is a perspective view illustrating an interior of an image forming apparatus according to a third embodiment of the present invention.

According to the third embodiment, the battery 104 is detachably attached to a bottom of the conveyor section 113 constituting the conveyance pathway.

At this time, between the connection terminal 107 or the connector to connect the battery 104 and the conveyor section 113, there is provided a shielding member, so that the connector is shielded from the pathway indicated by arrows of the movement or duct 211 of the mist.

With this configuration, mist does not adhere to the connection terminal 107 with the battery 104 of the apparatus body 101 disposed on the battery socket.

Figure 13:
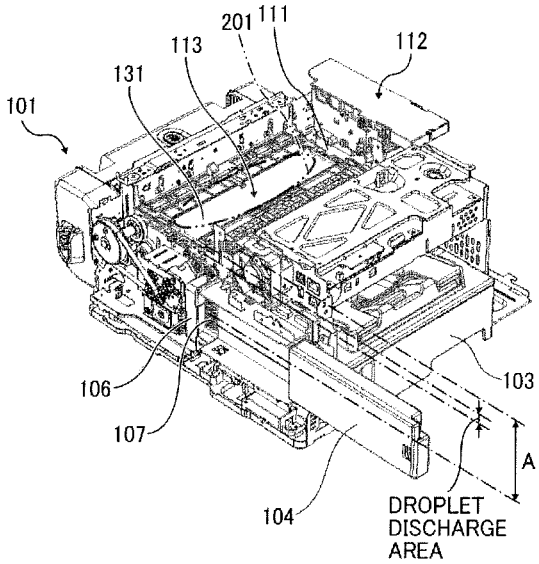
FIG. 13 is a perspective view illustrating an interior of an image forming apparatus according to a fourth embodiment of the present invention.

FIG. 13 is a perspective view illustrating an interior of an image forming apparatus according to the fourth embodiment of the present invention.

According to the fourth embodiment, similarly to the first embodiment, an area where the carriage unit 112 reciprocally moves is a droplet discharge area corresponding to the mist generation area 201.

In addition, the apparatus body 101 includes a fan 202 to generate airflow to collect the mist generated in the mist generation area 201.

Then, the mist generation area 201 as the droplet discharge area is defined, in the height direction of the apparatus body, between the connection terminal 107 as the connector to the battery 104 of the apparatus body and the fan 202 as an airflow generator, that is, an area A.

At this time, the connection terminal 107 as the connector to the battery 104 of the apparatus body is to be disposed outside the airflow path generated by the fan 202.

With this structure, the mist generated in the mist generation area 201 does not flow to the connection terminal 107 as the connector to the battery 104 of the apparatus body and is exhausted by the fan 202.

Accordingly, the mist is prevented from adhering to the connection terminal 107 with the battery 104 of the apparatus body 101.

Figure 14:
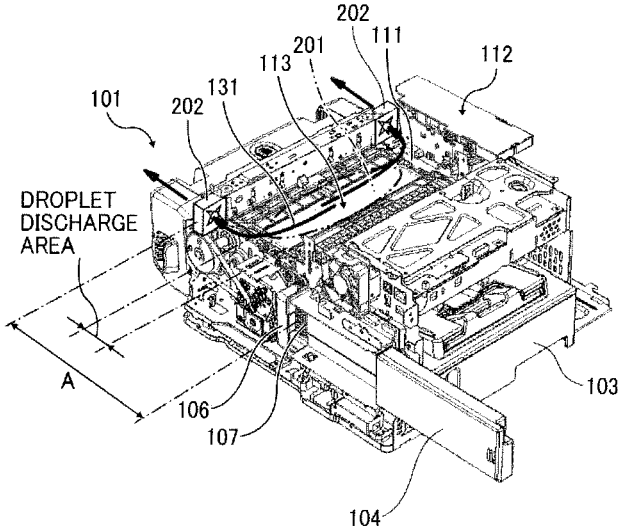
FIG. 14 is a perspective view illustrating an interior of an mage forming apparatus according to a fifth embodiment of the present invention.

FIG. 14 is a perspective view illustrating an interior of an image forming apparatus according to the fifth embodiment of the present invention.

In the present embodiment, fans 202*a*, 202*b* are disposed at opposed lateral ends in the carriage main scanning direction of the mist generation area 201, in the distal side (that is, on an opposite side of the detachable attachment of the battery 104) of the apparatus body. Accordingly, the mist moves along the mist movement 210 by airflow generated when the fan 202 is driven.

Specifically, the mist generation area 201 as the droplet discharge area is defined as an area A positioned between the connection terminal 107 as the connector to the battery 104 of the apparatus body and the fan 202 as an airflow generator.

At this time, the connection terminal 107 as the connector to the battery 104 of the apparatus body is to be disposed outside the airflow path generated by the fan 202.

With this structure, the mist generated in the mist generation area 201 does not flow to the connection terminal 107 as the connector to the battery 104 of the apparatus body and is exhausted by the fan 202.

Figure 15:
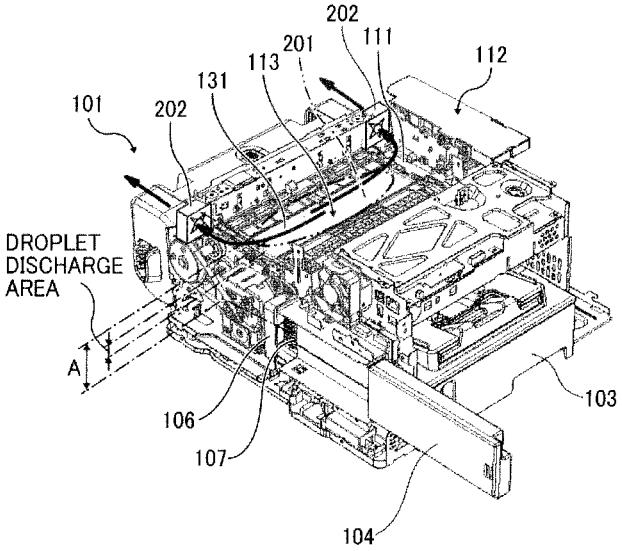
FIG. 15 is a perspective view illustrating an interior of an image forming apparatus according to a sixth embodiment of the present invention.

FIG. 15 is a perspective view illustrating an interior of an image forming apparatus according to a sixth embodiment of the present invention.

In the present embodiment, fans 202*a*, 202*b* (collectively, 202) are disposed at lateral ends in the carriage main scanning direction of the mist generation area 201 and in the distal side (that is, on an opposite side of the detachable attachment of the battery 104) of the apparatus body than the mist generation area 201. Accordingly, the mist moves along the mist movement 210 by an airflow generated when the fans 202 are driven.

Specifically, the mist generation area 201 as the droplet discharge area is defined, in the height direction of the apparatus body, by an area A between the connection terminal 107 as the connector to the battery 104 of the apparatus body and the fans 202 each as an airflow generator.

At this time, the connection terminal 107 as the connector to the battery 104 of the apparatus body is to be disposed outside the airflow path generated by the fans 202.

With this structure, the mist generated in the mist generation area 201 does not flow to the connection terminal 107 as the connector to the battery 104 of the apparatus body and is exhausted by the fans 202.

Figure 16:
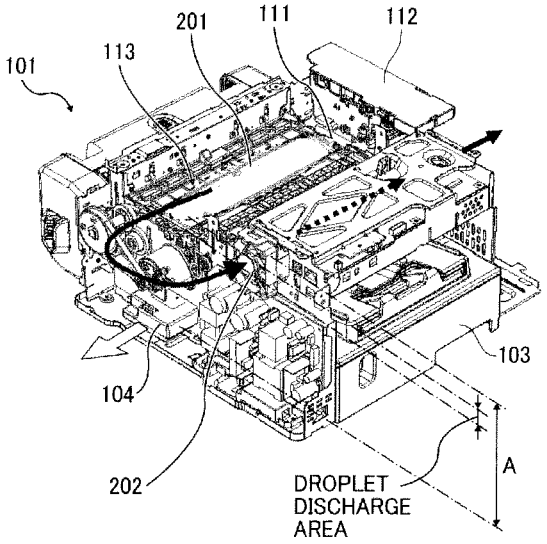
FIG. 16 is a perspective view illustrating an interior of an image forming apparatus according to a seventh embodiment of the present invention.

FIG. 16 is a perspective view illustrating an interior of an image forming apparatus according to the seventh embodiment of the present invention.

According to the seventh embodiment, similarly to the third embodiment, the battery 104 is detachably attached to a bottom of the conveyor section 113 constituting the conveyance pathway.

Specifically, in the height direction of the apparatus body, the mist generation area 201 as the droplet discharge area is defined as an area A between the connection terminal 107 as the connector to the battery 104 of the apparatus body and the fan 202 as an airflow generator.

At this time, the connection terminal 107 as the connector to the battery 104 of the apparatus body is to be disposed outside the airflow path generated by the fan 202.

With this structure, the mist generated in the mist generation area 201 does not flow toward the connection terminal 107 as the connector to the battery 104 of the apparatus body and is exhausted by the fan 202.

Figure 17:
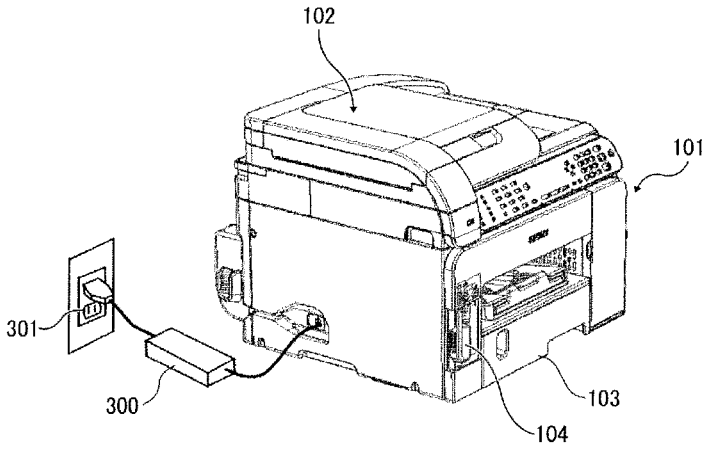
FIG. 17 is an external perspective view of an image forming apparatus according o an eighth embodiment of the present invention.
Figure 18:
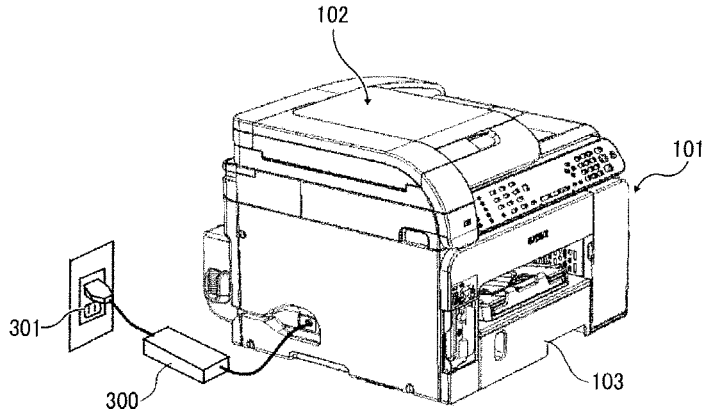
FIG. 18 is an external perspective view of the image forming apparatus according to the eighth embodiment of FIG. 17.

FIGS. 17 and 18 are external perspective views of an image forming apparatus 100 according to the eighth embodiment of the present invention.

In the eighth embodiment, power is supplied via an AC adapter 300 connected to a commercial power supply 301. In this case, as illustrated in FIG. 17, with the battery 104 connected to the apparatus body 101, the battery 104 can be charged. Further, as illustrated in FIG. 18, the image forming apparatus can be used with the battery 104 removed from the apparatus body 101.

In either case, when the AC adapter 300 is connected to the apparatus body 101, power is supplied via the AC adapter 300 and the image forming apparatus can be operated.

Charging and discharging are repeated when the battery 104 is attached to the apparatus. There is a limit to the number of times the battery 104 can be recharged. Accordingly, when the apparatus can be operated without attaching the battery 104, the lifetime of the battery 104 can be extended.

When the apparatus is operated without attaching the battery 104, the ink mist is generated with the connection terminal 107 exposed. But with the connection terminal 107 configured as in any of the first to seventh embodiments, the quantity of mist adhered to the connection terminal 107 as the connector to the battery of the apparatus body is reduced and a stable power supply can be performed when power is supplied from the battery.

In each of the above embodiments, the fan or the airflow generator is operated when the image forming operation is not performed and power is supplied via the AC adapter with the battery removed from the apparatus body. Accordingly, when the image forming operation is performed, power consumption in driving the fan can be reduced and power can be used for the image forming operation on a priority basis.

Herein, the term "image forming apparatus" means an apparatus that performs image formation by impacting ink droplets against various media such as paper, thread, fiber, fabric, leather, metals, plastics, glass, wood, ceramics, and the like. "Image formation" means not only forming images with letters or figures having meaning to the medium, but also forming images without meaning such as patterns to the medium (and simply impacting the droplets to the medium).

"Ink" is not limited to so-called ink, but means and is used as an inclusive term for every liquid such as recording liquid, fixing liquid, and aqueous fluid to be used for image formation, which further includes, for example, DNA samples, registration and pattern materials and resins.

The term "image" is not limited to a plane two-dimensional one, but also includes a three-dimensional one, and the image formed by three-dimensionally from the 3D figure itself. Further, the image forming apparatus includes both serial- and line-type image forming apparatuses.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an apparatus body;

a recording head to discharge droplets onto a recording medium, wherein a mist is generated when droplets are discharged to form an image;

a battery, detachably disposed inside the apparatus body, to supply power necessary for operation of the apparatus body;

a connection terminal to connect the battery to the apparatus body, the connection terminal being disposed outside a movement of the mist which is to be discharged to outside the apparatus body and was generated when the recording head discharged the droplets;

a duct that collects the mist generated when the recording head discharges the droplets; and a partition member disposed between the connection terminal and the duct.

2. The image forming apparatus as claimed in claim 1, wherein the connection terminal is shielded from the movement of the mist generated when the recording head discharges the droplets.

3. The image forming apparatus as claimed in claim 1, wherein the partition member forms a part of the duct.

4. The image forming apparatus as claimed in claim 1, further comprising a sheet feed cassette containing the recording media, wherein the battery is detachably disposed above the sheet feed cassette.

5. The image forming apparatus as claimed in claim 1, wherein the battery is detachably disposed below a conveyance pathway of the recording media.

6. The image forming apparatus as claimed in claim 1, further comprising an airflow generator to generate airflow to move mist generated when the recording head discharges the droplets, wherein a droplet discharge area where the recording head discharges the droplets positions between the connection terminal and the airflow generator.

7. The image forming apparatus as claimed in claim 6, wherein the connection terminal to connect the battery to the apparatus body positions outside an airflow path generated by the airflow generator.

8. The image forming apparatus as claimed in claim 1, further comprising an AC adapter connected to a commercial power supply, wherein power can be supplied to the apparatus body via the AC adapter when the battery is detached.

* * * * *